US006971939B2

(12) United States Patent
Claus et al.

(10) Patent No.: US 6,971,939 B2
(45) Date of Patent: Dec. 6, 2005

(54) NON-OXIDIZING ELECTRODE ARRANGEMENT FOR EXCIMER LAMPS

(75) Inventors: Holger Claus, Lake Forest, CA (US); Zoran Falkenstein, Rancho St. Margarita, CA (US)

(73) Assignee: Ushio America, Inc., Irvine, CA (US)

( * ) Notice: Subject to any disclaimer, the term of this patent is extended or adjusted under 35 U.S.C. 154(b) by 0 days.

(21) Appl. No.: 10/857,069

(22) Filed: May 28, 2004

(65) Prior Publication Data

US 2004/0263043 A1 Dec. 30, 2004

Related U.S. Application Data

(60) Provisional application No. 60/474,010, filed on May 29, 2003.

(51) Int. Cl.[7] ..... H01J 17/16
(52) U.S. Cl. ..... 445/46; 445/48
(58) Field of Search ..... 445/46, 48, 53, 445/56, 35, 26, 27; 313/594, 607

(56) References Cited

U.S. PATENT DOCUMENTS 4,837,484 A * 6/1989 Eliasson et al. ..... 313/634
5,214,344 A * 5/1993 Kogelschatz ..... 313/17
5,343,114 A * 8/1994 Beneking et al. ..... 313/485
5,397,259 A * 3/1995 Zaslavsky et al. ..... 445/29
5,581,152 A * 12/1996 Matsuno et al. ..... 313/634
5,763,999 A * 6/1998 Matsuno et al. ..... 313/573
5,849,107 A * 12/1998 Itoyama et al. ..... 136/248
5,993,278 A * 11/1999 Falkenstein ..... 445/26
6,525,451 B1 * 2/2003 Hishinuma et al. ..... 313/234
6,633,109 B2 * 10/2003 Falkenstein ..... 313/29
6,634,917 B1 * 10/2003 Kling et al. ..... 445/25
6,747,419 B2 * 6/2004 Claus et al. ..... 315/248
6,762,556 B2 * 7/2004 Winsor ..... 313/607

* cited by examiner

*Primary Examiner*—Joseph Williams
*Assistant Examiner*—Dalei Dong
(74) *Attorney, Agent, or Firm*—Bradley D. Blanche; Greenberg Traurig LLP

(57) ABSTRACT

A non-oxidizing electrode arrangement for an excimer lamp that is formed by coating an electrode of the lamp with a layer of protective layer that prevents the electrode from oxidizing. The protective layer is preferably transparent and possesses a low permeability for oxygen (e.g., silicon oxide, magnesium fluoride, calcium fluoride). The interior of the excimer lamp is evacuated to a pressure level that is lower than the pressure level surrounding the excimer lamp at any time during the non-oxidizing electrode formation process in order to assist in preventing the excimer lamp from fracturing.

12 Claims, 6 Drawing Sheets

NON-OXIDIZING ELECTRODE ARRANGEMENT FOR EXCIMER LAMPS

RELATED APPLICATIONS

This application is a continuation of U.S. Provisional Patent Application Ser. No. 60/474,010, filed on May 29, 2003, entitled, "Non-Oxidizing Electrode Arrangement for Excimer V(UV) Lamps."

BACKGROUND OF THE INVENTION

1. Technical Field

The present invention relates to the field of excimer lamps, and in particular to a non-oxidizing electrode arrangement for an excimer (V)UV lamp.

2. Description of Related Art

The electrodes of prior art excimer lamps which emit in the VUV spectral range are susceptible to oxidation when operated in air, leading to corrosive deterioration of the electrode material. The oxidation is particularly pronounced with ultra-violet (UV) or deep ultra-violet (VUV) light sources as the emitted UV or VUV radiation produces atomic oxygen and ozone in the very proximity of the electrodes. Both atomic oxygen and ozone are extremely strong oxidizers that will readily oxidize prior art excimer lamp electrodes. These problems can be better understood with a review of excimer lamps.

In excimer lamps, excited diatomic molecules (excimers) are generated by an electrical gas discharge in rare gases or rare gas/halogen mixtures at gas pressures of 50–5000 Torr. When the excimer decays, it generates spectrally selective, narrow-banded radiation in the VUV, UV or visible spectral range, which can be used for various photo-initiated or photo-sensitized applications for solids, liquids and gases.

One form of electrical excitation is given by dielectric barrier discharges (DBDs). In a DBD-driven excimer lamp, a high voltage is applied across a gas gap, which is separated from metallic electrodes by at least one dielectric barrier. Dielectric barriers in excimer lamps include, for instance, glass or quartz which allow the emission of the radiation generated by the excimer. FIG. 1A provides an example of a typical DBD driven excimer lamp.

FIG. 1A is a side view of a coaxial DBD-driven excimer lamp, which is a configuration commonly utilized for excimer lamps. The lamp envelope 100 is a transparent vessel that is typically comprised of glass or quartz. In common arrangements, an inner electrode 110 is separated by a dielectric barrier 120 from the excimer gas 130 enclosed within the envelope 100 and bounded on the outside by a second electrode 140 on the outer surface of the dielectric barrier.

FIG. 1B provides a cross-sectional end view of the same coaxial DBD lamp shown in FIG. 1A. In FIG. 1B, it can be seen more clearly that the inner electrode 110 and the outer electrode 140 are circular in shape, and that the excimer gas 130 is sealed between the two dielectric barriers 120. The second electrode 140 may be a mesh which allows radiation from the plasma to be transmitted through the lamp envelope. The discharge from a DBD-driven excimer lamp is also widely known as "ozonizer discharge" as the utilization of DBDs in air (or oxygen) is a mature technology to produce large amounts of ozone.

Typical efficiencies of DBD-driven excimer VUV light sources depend on the electron densities and electron energy distribution function and can be "controlled" mainly by the applied voltage frequency and shape, gas pressure, gas composition and gas gap distance. Under usual conditions (several 10 kHz AC voltage, several 100 Torr gas pressure, few mm gap spacing), the radiant efficiency of DBD-driven lamps are in the range of 1–15% efficiency. Using other excitation voltages (such as steep-rising voltage pulses), UV efficiencies in the range of 20–40% can be obtained.

The uniqueness of excimer (V)UV light sources is that nearly all of the radiation is emitted in a spectrally selectively, and relatively narrow-banded spectral region. In fact, for photo-initiated or photo-sensitized processes, the emission can be considered quasi-monochromatic. Since many photo-physical and photo-chemical processes (e.g., UV curing and bonding, lacquer hardening, polymerization, material deposition, and UV oxidation) are initiated by a specific wavelength (ideally the excimer light source will emit close to those wavelengths), these light sources can be by far more effective than high-powered light sources that usually emit into a wide spectral range.

A problem arises when UV or VUV producing excimer light sources (lamps) are intended to be operated in oxygen-containing environments such as air. This is for example the case with Xenon excimer lamp systems (emitting at 172±7 nm) that utilize the VUV radiation for photochemical cleaning of surfaces in air (or similar). In this process the VUV radiation is used to photo dissociate molecular oxygen, leading to the formation of atomic oxygen and subsequently ozone, both of which are extremely strong oxidizing agents. As the atomic oxygen and/or ozone reach the surface of the material to be cleaned, a radical reaction with the surface contaminant is initiated, leading the removal of contaminants through a process called "advanced oxidation" or "cold combustion". Unfortunately, just as the atomic oxygen and ozone react with the surface contaminants, they also readily oxidize the electrodes. Eventually, the electrodes oxidize enough that the lamp's performance is adversely affected.

One prior art solution to prevent oxidation of the excimer lamp's electrodes is to operate the sources in a lamp housing that is flushed with an inert, oxygen-free gas (typically pure nitrogen). The lamp housing also contains a transparent window, which allows the VUV radiation to be introduced into the oxygen-containing processing gas (e.g., air) where the photochemical cleaning takes place. An example of such a system is illustrated in FIG. 2 as a cross-sectional view of an excimer lamp system. Electrode 200 is positioned between lamp wall 210 and the transparent window 220 (e.g., the quartz layer). The surface 240 to be treated by the VUV radiation is located on the other side of the transparent window 220 from the electrode 200. The gap between lamp wall 210 and quartz layer 220 is filled with an oxygen-free environment 230 (e.g., nitrogen gas).

While this method protects the electrodes from oxidation, the protective quartz layer 220 and the positioning of the VUV sources in the inert gas filled lamp housing also increases the minimum distance between the treatment surface 240 and the electrode 200 on the lamp surface. The intensity on the system window (i.e., the protective quartz layer) is lower than on the excimer lamp itself, and hence more powerful and expensive lamps must be used for a purged excimer (V)UV system to obtain the same result as with a bare bulb. The protective quartz layer and the purged lamp housing also add to the cost of the excimer lamps.

SUMMARY

The following is a summary of various aspects and advantages realizable according to various embodiments of the non-oxidizing electrode arrangement for an excimer lamp according to the present invention. It is provided as an introduction to assist those skilled in the art to more rapidly assimilate the detailed discussion of the invention that ensues and does not and is not intended in any way to limit the scope of the claims that are appended hereto.

The various embodiments described below are directed to a method of forming a non-oxidizing electrode arrangement for an excimer lamp by coating an electrode of the lamp with a layer of protective media that prevents the electrode from oxidizing. The protective media should be transparent when the output radiation of the lamp is intended to pass through, where one or both of the electrodes of the excimer lamp is coated with a transparent layer of protective media (e.g., silicon oxide, magnesium fluoride, calcium fluoride) to prevent oxidation of the electrode during lamp operation. The transparent layer of protective media is pure enough to allow transmission of desired frequencies of light. The transparent layer is preferably formed as a very thin layer (e.g., approximately 1 micrometer). Any coating that prevents oxidation and still allows the transmission of the desired light frequencies can be utilized for the protective media.

When the excimer lamp is configured as a DBD lamp, where one or both of the two electrodes is formed directly on a surface of the excimer lamp by coating a dielectric surface with a conductive material (e.g., aluminum or other metal), both the electrode and the dielectric are preferably coated with the protective media. In one embodiment, the electrode is formed on the lamp surface in the shape of a mesh (or grid), where the pattern of the mesh or grid can be chosen to provide a desired level of optical transmission through the electrode. When the electrode being covered is a grid, both the conductive material and the space between the conductive material that makes up the grid are preferably coated by the protective media.

Before forming the non-oxidizing electrode arrangement on the surface of the excimer lamp, the interior of the lamp is preferably evacuated to a pressure level that is lower than the pressure level surrounding the excimer lamp at any time during the electrode formation process. Keeping the pressure surrounding the excimer lamp from exceeding the pressure within the interior of the lamp during the electrode formation process helps maintain the structure integrity of the lamp, especially when the lamp is a flat excimer lamp.

BRIEF DESCRIPTION OF THE DRAWINGS

The features of the present invention are set forth with particularity in the appended claims. The present invention, both as to its organization and manner of operation, together with further advantages, may best be understood by reference to the following description, taken in connection with the accompanying drawings in which the reference numerals designate like parts throughout the figures thereof and wherein:

DETAILED DESCRIPTION OF THE INVENTION

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a non-oxidizing electrode arrangement for an excimer lamp.

Figure 1B:
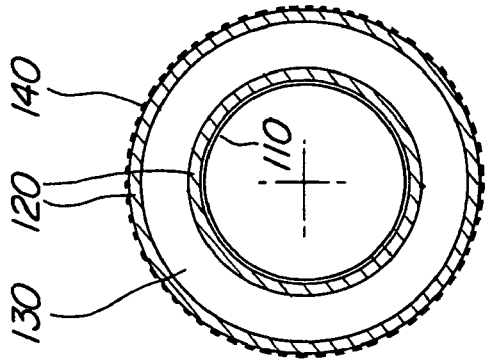
FIGS. 1A and 1B are side and end views, respectively, of a coaxial DBD lamp.
Figure 1A:
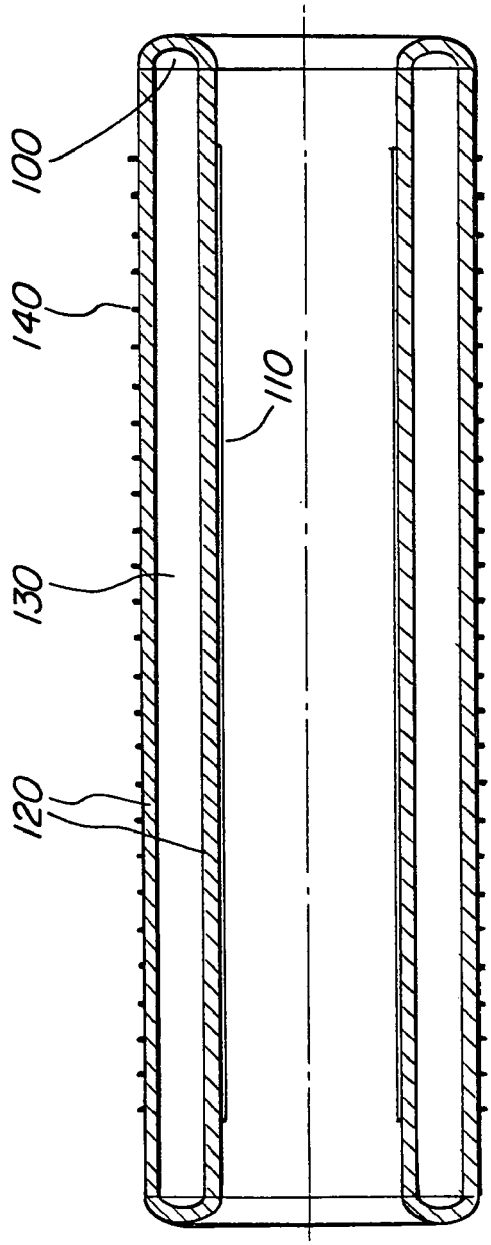
Figure 2:
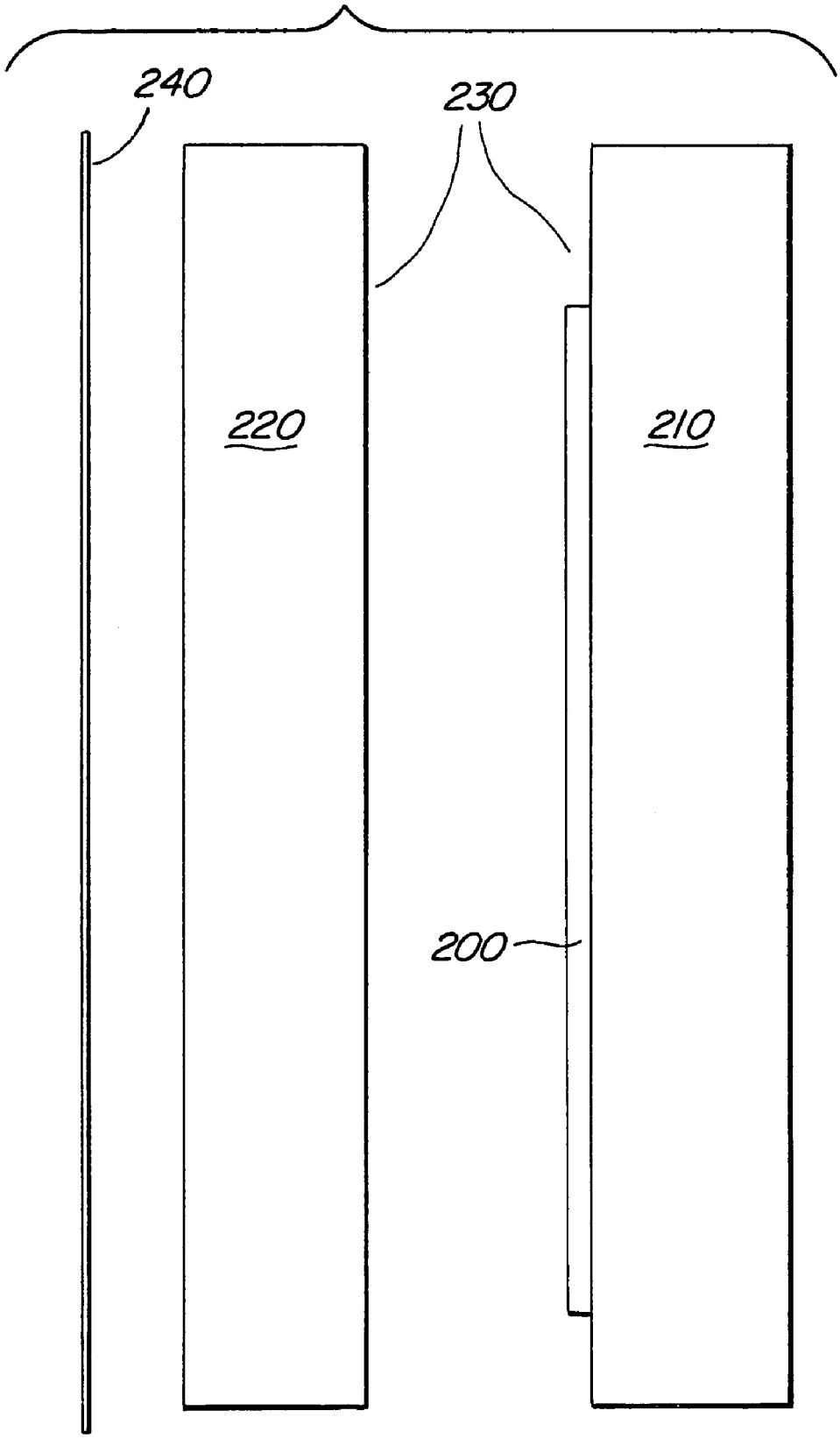
FIG. 2 is a block diagram of a cross-sectional view of an excimer lamp system with an electrode in an oxygen-free environment.
Figure 3:
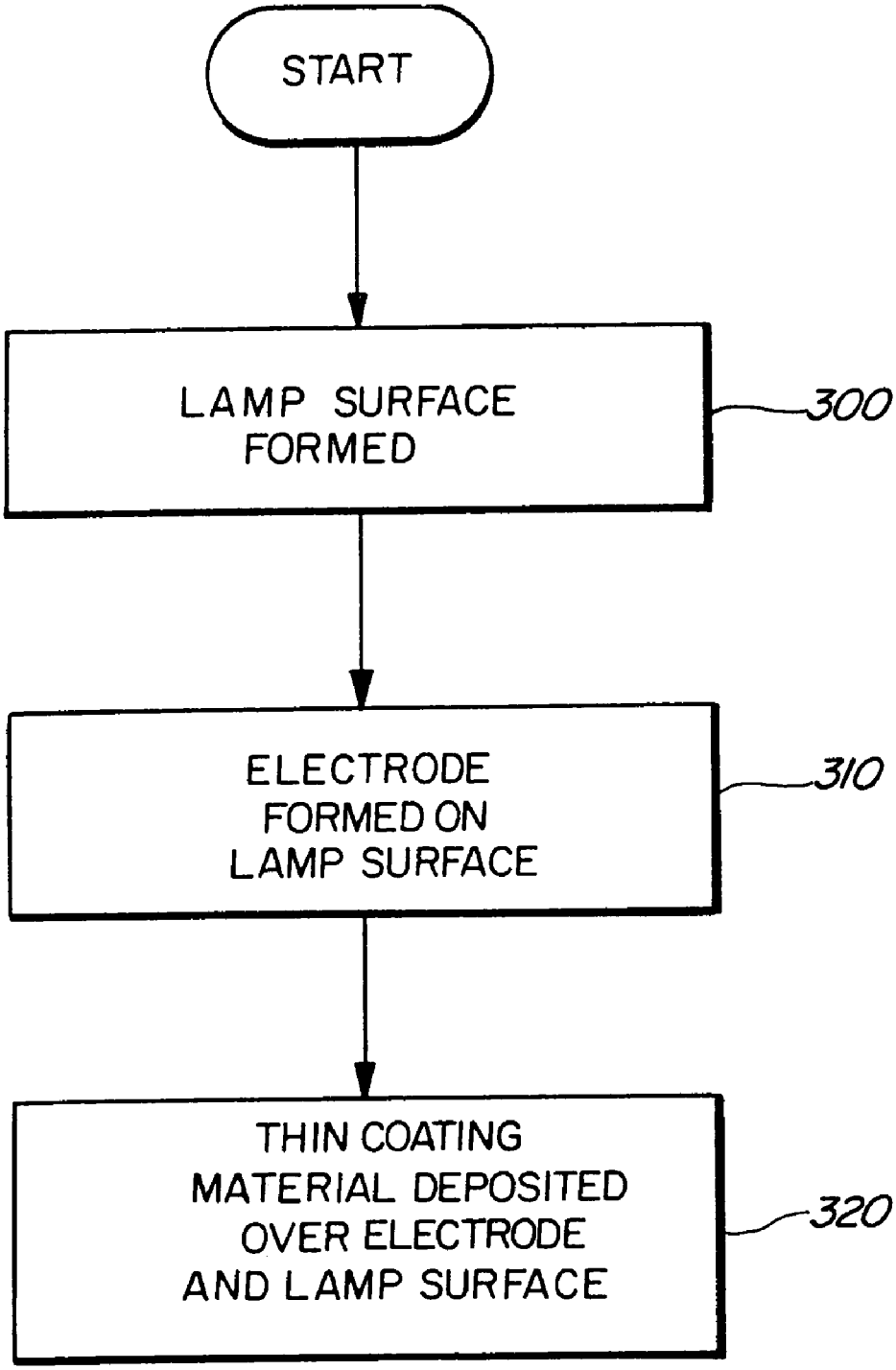
FIG. 3 is a flow diagram of a preferred embodiment for forming a non-oxidizing electrode arrangement for an excimer lamp.

Referring now to FIG. 3, a process of forming a non-oxidizing electrode in accordance with a preferred embodiment is illustrated. At block 300, the lamp body surface is formed. The lamp body surface may comprise any type of excimer lamp structure known to those skilled in the art and typically includes a dielectric material (e.g., quartz, glass). At block 310, an electrode is formed on the lamp surface. The electrode may be formed on the lamp surface in any manner known to those skilled in the art of electrode formation. In a preferred embodiment, a conductive material (e.g., aluminum or the like) is deposited upon the lamp surface. The conductive material may be deposed on the lamp surface using any variety of deposition techniques, including but not limited to chemical vapor deposition, physical vapor deposition, screen printing, sputtering or other known semi-conductor deposition processes.

In block 320, a protective layer is deposited over the electrode that separates the electrode from an environment adjacent to the excimer lamp. The electrode and/or the surface of the excimer lamp is coated with the protective layer to prevent oxidation of the electrode during lamp operation or otherwise during exposure to oxygen in the surrounding environment. The protective layer is preferably formed to be transparent to at least one desired light frequency. The present invention is intended to be utilized with any type of excimer lamp, such as those containing excimers that emit radiation in the deep ultra-violet ((V)UV), the ultra-violet (UV), or the visible spectral range. The protective layer is pure enough to allow transmission of the desired frequencies of light. In one embodiment, the silicon oxide layer is a very thin layer (e.g., approximately 1 micrometer). The protective layer preferably must possess a low permeability for oxygen and be light transmissive. The protective layer preferably comprises at least one of silicon dioxide, magnesium fluoride or calcium fluoride.

Since the protective layer protects the electrode from oxidizing molecules in the environment, conventional quartz plates and inert purge gases are not required for the excimer lamp housing. Thus, the excimer lamp is able to get closer to treatment surfaces than prior art lamps without the electrode oxidizing, and lamp efficiency (i.e., system efficiency) is improved. This is particularly advantageous with flat panel excimer lamps for irradiating large treatment surfaces at close range; however the present invention is intended to be utilized with any excimer lamp configuration, including but not limited to the excimer lamps as described in United States Patent Application Publication No. 2002/0067130, Ser. No. 09/730,185, filed Dec. 5, 2000, entitled, "Flat-Panel, Large-Area, Dielectric Barrier Discharge-Driven V(UV) Light Source," the contents of which are hereby incorporated by reference.

Figure 4:
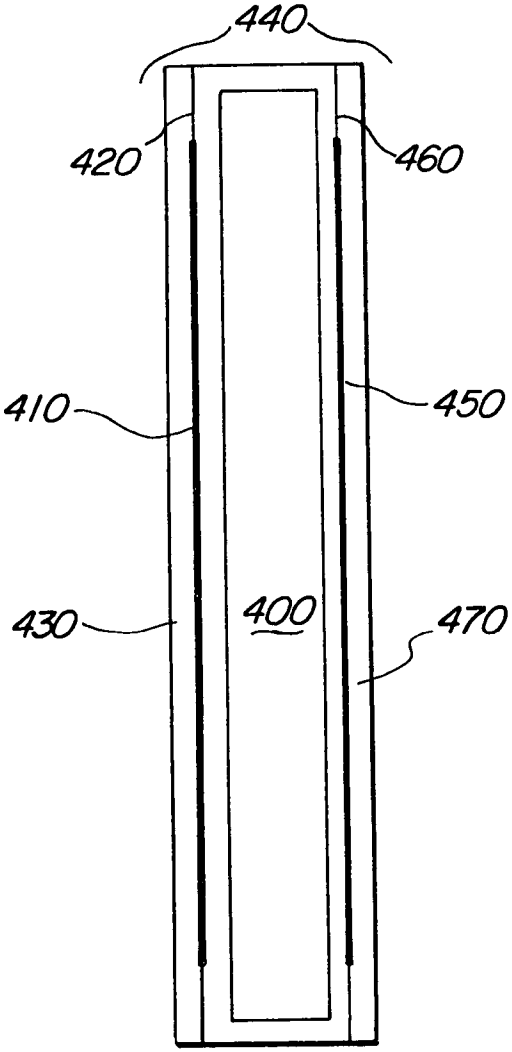
FIG. 4 is a block diagram side view of another preferred embodiment for the non-oxidizing electrode arrangement for an excimer lamp

Referring now to FIG. 4, a preferred embodiment of a flat panel excimer lamp 400 is illustrated including a first electrode 410 formed on a first surface 420 of the lamp 400 that is covered by a protective layer 430. As discussed above, the protective layer 430 is composed of a substance that allows the desired frequencies of light to pass through (e.g., silicon oxide, magnesium fluoride, calcium fluoride), but separates the electrode 410 from the environment 440 adjacent to the lamp 400 (which may or may not contain oxygen) to prevent oxidation of the first electrode 410.

A second electrode 450 is formed on the opposite surface 460 of the flat excimer lamp 400 and may similarly be covered with a protective layer 470. The protective layer 470 may also be composed of the same substance as protective layer 430; however, in some embodiments, different substances are used to form the two protective layers.

Figure 5:
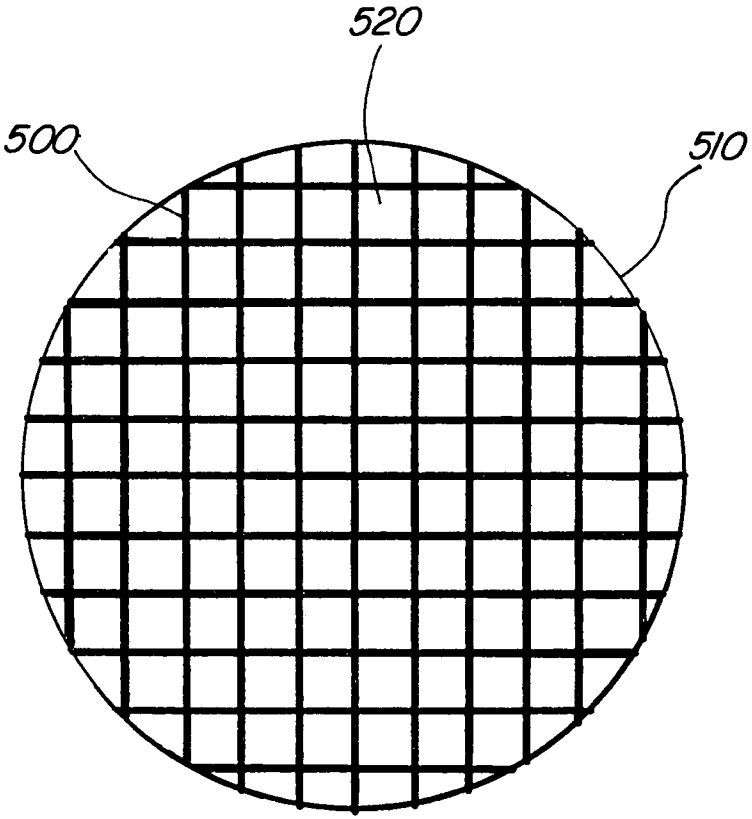
FIG. 5 is a top view of another preferred embodiment of the non-oxidizing electrode arrangement having a mesh-shaped electrode formed on the surface of an excimer lamp.

In another preferred embodiment, at least one of the electrodes formed on the surface of the excimer lamp is formed in the shape of a mesh (or grid), as illustrated in FIG. 5. An electrode 500 is formed on a surface 510 of the flat excimer lamp. The electrode 500 has a grid shape that allows light to pass through the openings 520 of the grid. The pattern of the mesh may be selected to provide a desired optical transmission of light to pass there through. The electrode grid preferably has an optical transmission of at least 70%, but may comprise any level of desired optical transmission. When the electrode being covered is a grid, both the conductive material and the space between the conductive material that make up the grid are preferably coated by the protective layer preventing oxidation.

Figure 6:
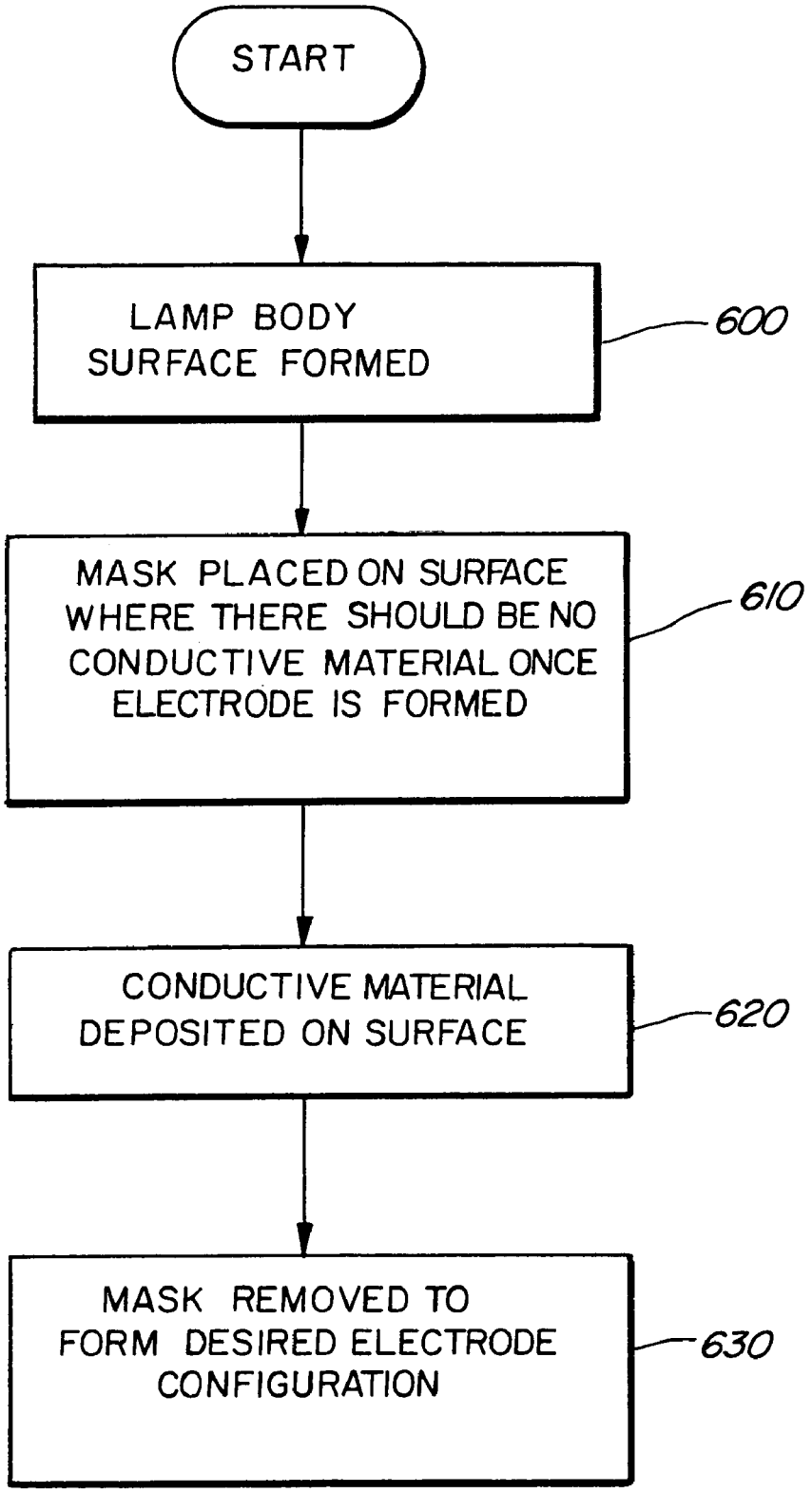
FIG. 6 is a flow diagram of a preferred embodiment for forming a grid-shaped electrode for the non-oxidizing electrode arrangement for an excimer lamp.

FIG. 6 illustrates an operational flow diagram of a preferred embodiment for forming a grid-shaped electrode 500. At block 600, the lamp body surface is formed. At block 610, a mask is placed on the surface where there should be no conductive material once the electrode 500 is formed. At block 620, a conductive material is deposited on the surface 510. Once the conductive material is deposited, the mask is removed at block 630 to form the desired electrode configuration. It is also possible to form the mesh surface electrode using processes known to those skilled in the art, such as a photolithography process that etches the mesh structure onto the surface of the lamp.

The second electrode 450 that is formed on the opposite surface 460 of excimer lamp may comprise any type of electrode configuration. In one preferred embodiment, the second electrode is not directly applied to the surface of the lamp. For example, a flat, conductive surface (e.g., a polished aluminum disk) may be positioned against the opposite surface 460 that acts as the second electrode 450. In other preferred embodiments, the second electrode 450 is also applied deposited on the opposite surface 460 of the lamp in similar fashion as any of the above-described deposition techniques for the first electrode 410. The second electrode 450 may be formed without gaps (i.e., as a continuous solid piece) or may be grid-shaped.

Flat excimer lamps are structurally sound when the pressure outside the lamp is higher than the pressure inside the lamp. However, flat excimer lamps are not as structurally sound when that pressure difference is eliminated or reversed. This can be problematic during excimer lamp formation, because many of the formation steps and deposition processes are performed in a relative vacuum. Thus, when the pressure in the environment outside the lamp is reduced to form the electrodes and protective layer, the lamp could fracture.

To avoid the pressure differential problem, before the electrode is formed on the surface of the flat excimer lamp, the interior of the lamp is evacuated to a pressure level that does not exceed the pressure level of the environment surrounding the flat excimer lamp at any time during the electrode formation process. The interior pressure of the excimer lamp is preferably maintained at a level lower than external pressure of the excimer lamp. For example, in one embodiment, the interior of the lamp is evacuated to a pressure level of less than $10^{-2}$ torr (preferably lower than this pressure level), and the pressure level outside the lamp when the electrode is formed is approximately 1–20 torr.

Figure 7:
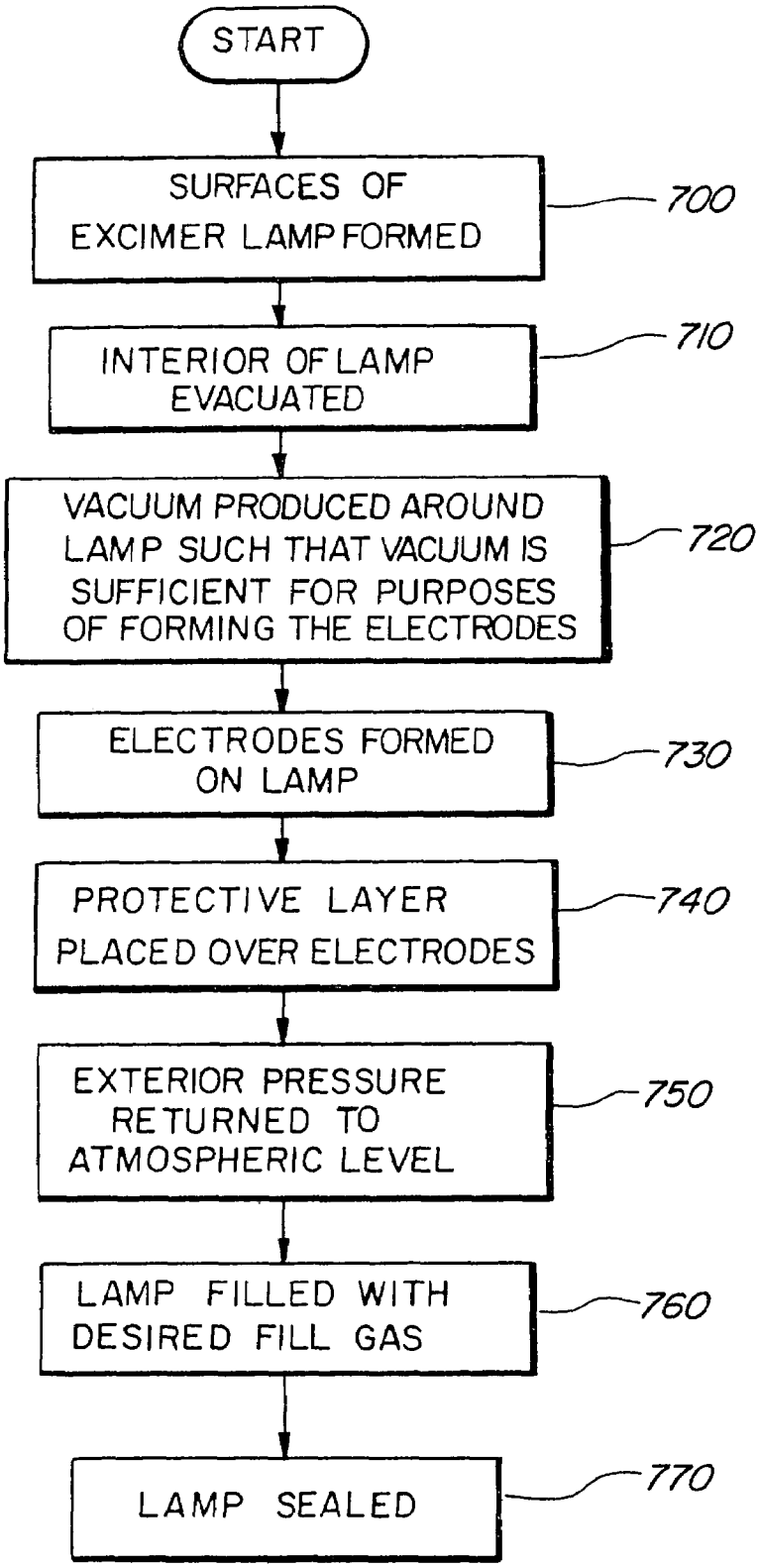
FIG. 7 is a flow diagram of yet another preferred embodiment for forming the non-oxidizing electrode arrangement for an excimer lamp.

FIG. 7 illustrates an operational flow diagram of a preferred embodiment for making an excimer lamp by maintained a desired pressure differential between the inside and the outside of the excimer lamp. At block 700, the surfaces of the excimer lamp are formed. At block 710, the interior of the lamp is evacuated. At block 720, a vacuum is produced around the lamp such that the vacuum is sufficient for purposes of forming the electrodes and the protective layer, but the exterior pressure level is still sufficiently above the interior pressure level of the lamp to prevent damage to the lamp.

At block 730, the electrodes are formed on the lamp. At block 740, a protective layer is placed over the electrodes. At block 750, the exterior pressure is returned to atmospheric level. In some embodiments, the order of blocks 740 and 750 are reversed. At block 760, the lamp is filled with the desired fill gas. At block 770, the lamp is sealed.

The different structures of the non-oxidizing electrode arrangement for an excimer lamp of the present invention are described separately in each of the above embodiments. However, it is the full intention of the inventors of the present invention that the separate aspects of each embodiment described herein may be combined with the other embodiments described herein. Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A method of forming a non-oxidizing electrode arrangement for an excimer lamp comprising:

lowering a pressure within an interior of said excimer lamp to a value not exceeding a pressure surrounding an exterior of said excimer lamp;

forming a non-oxidizing electrode arrangement on a surface of said excimer lamp; and maintaining said pressure within said interior of said excimer lamp to a value not exceeding a pressure surrounding said exterior of said excimer lamp during the formation of said electrode.

2. The method of claim 1, wherein said interior pressure lowering step is accomplished by evacuating said interior of excimer lamp.

3. The method of claim 2, wherein said interior pressure of said excimer lamp is evacuated to a pressure level of less than 10-2 torr.

4. The method of claim 3, wherein said pressure surrounding said exterior of said excimer lamp is approximately 1–20 torr.

5. The method of claim 1, wherein said non-oxidizing electrode arrangement forming step comprises:

forming an electrode on a surface of said excimer lamp; and covering said electrode with a protective layer that separates said electrode from an environment adjacent to said excimer lamp.

6. The method of claim 5, wherein said protective layer prevents said electrode from being oxidized by the environment adjacent to said excimer lamp.

7. The method of claim 5, wherein said protective layer is transparent to at least one light frequency.

8. The method of claim 7, wherein said protective layer is at least one of a silicon dioxide layer, a magnesium fluoride layer or a calcium fluoride layer.

9. The method of claim 1, wherein said surface of said excimer lamp remains intact during the non-oxidizing electrode arrangement formation step.

10. A method of forming electrodes on an excimer lamp, comprising:

forming a excimer lamp body having an interior and an exterior;

lowering a pressure on said exterior of said excimer lamp body to a value less than atmospheric pressure;

lowering a pressure within an interior of said excimer lamp to a value not exceeding said pressure surrounding an exterior of said excimer lamp;

forming an electrode on a surface of said excimer lamp; and maintaining said pressure within said interior of said excimer lamp to a value not exceeding a pressure surrounding said exterior of said excimer lamp during the formation of said electrode.

11. The method of claim 10, wherein said excimer lamp body remains intact during said electrode formation step.

12. The method of claim 10, wherein said excimer lamp body formation step is performed prior to said electrode formation step.

* * * * *